United States Patent [19]

Sawazaki et al.

[11] Patent Number: 4,656,842

[45] Date of Patent: Apr. 14, 1987

[54] YARN FEEDING AND CHANGING APPARATUS FOR CIRCULAR KNITTING MACHINE

[75] Inventors: Masatoshi Sawazaki, Kobe; Hidetoshi So, Ashiya, both of Japan

[73] Assignee: Precision Fukuhara Works, Ltd., Japan

[21] Appl. No.: 831,640

[22] Filed: Feb. 21, 1986

[30] Foreign Application Priority Data

Mar. 2, 1985 [JP] Japan ..... 60-41496

[51] Int. Cl.[4] ..... D04B 15/60

[52] U.S. Cl. ..... 66/139; 66/140 R; 66/146

[58] Field of Search ..... 66/134, 139, 140 R, 66/146

[56] References Cited

U.S. PATENT DOCUMENTS

| | | | |
|---|---|---|---|
| 1,129,261 | 2/1915 | Wilcomb | 66/140 R X |
| 2,295,450 | 9/1942 | Cole | 66/134 |
| 3,018,646 | 1/1962 | Wainwright | 66/140 R |
| 3,995,456 | 12/1976 | Wright | 66/140 R |

FOREIGN PATENT DOCUMENTS

| | | | |
|---|---|---|---|
| 2507815 | 9/1975 | Fed. Rep. of Germany | 66/140 R |
| 2710044 | 9/1977 | Fed. Rep. of Germany | 66/139 |
| 512170 | 8/1939 | United Kingdom | 66/140 R |
| 1020710 | 2/1966 | United Kingdom | 66/140 R |

*Primary Examiner*—Wm. Carter Reynolds

*Attorney, Agent, or Firm*—Bell, Seltzer, Park & Gibson

[57] ABSTRACT

An individual yarn clamping and cutting device is provided for each yarn guide and is moved to an open position in response to movement of the yarn guide from active to inactive position. The yarn clamping and cutting devices are moved to a closed position by cam means carried by the rotating needle cylinder. A yarn guide shifting cam is provided for imparting a slight amount of downward movement to the yarn guides to shift the same from a first upper active position to a second slightly lower active yarn feeding position during introduction of the yarn to reduce the tension in the yarn as the needles begin to knit and to aid in preventing yarn breakage. The yarn guides are mounted to facilitate individual threading of the yarn guides and are mounted for outward tilting movement of their upper ends to a readily accessible threading position while the remaining yarn guides remain in the normal operating position.

13 Claims, 14 Drawing Figures

YARN FEEDING AND CHANGING APPARATUS FOR CIRCULAR KNITTING MACHINE

FIELD OF THE INVENTION

This invention relates generally to a yarn feeding and changing apparatus for circular knitting machines, and more particularly to improvements in a yarn feeding and changing apparatus of the type disclosed in Japanese Patent Application No. 52-25326, filed on Mar. 8, 1977 (Laid-Open No. 52-110964), in which the name of the applicant was changed to the name of the assignee of the present application after the application was laid open. Said Japanese Patent Application corresponds to British Patent No. 1563653 of Mar. 8, 1977.

BACKGROUND OF THE INVENTION

Generally, the yarn feeding and changing apparatus of the knitting machine disclosed in said Japanese application is provided with a plurality of yarn guides selectively movable between the inactive position and the active position at each of a plurality of knitting stations. The yarn guides are moved by a program controlled selecting device to selectively feed different types of yarn to the knitting needles at each knitting station. One end of each of the yarn guides is connected by a link to one arm of a bell crank with the other arm being connected to the upper end of a vertically movable feed finger operating slide. The lower end of the operating slide is swingable radially in an annular groove in a dial hub. A selection butt and a control butt are provided on the inner side of each of the feed finger operating slides while a returning butt is provided on the outer side of each of the feed finger operating slides. A raising cam is provided on the inner end of the annular groove for engaging the control butt and raising the feed finger operating slides while a returning cam is provided on the outer side of the annular groove for engaging the returning butt and lowering the feed finger operating slides. An advancing cam is supported on the outer side of the annular groove for engaging and swinging the feed finger operating slides inwardly of the knitting machine and a selecting device is provided with selectors which selectively engage selector butts vertically spaced along the feed finger operating slides. The selectors are individually controlled by corresponding electromagnets to control the position of the yarn guides between active and inactive positions.

While the yarn feeding and changing apparatus of said Japanese application is effective to change the yarn guides, the yarn ends extending from each group of yarn guides are cut by a movable cutter in conjunction with a stationary cutter and are clamped by a single yarn clamping device. Therefore, when yarns of different kinds and counts are fed adjacent to each other, the clamped yarn ends are likely to slip from the clamping device and are not positively held thereby. Also, the yarn ends held with resilient pressure in the clamping device are tensioned and cut at the time of starting yarn feeding to the needles so that, in some cases, small pieces of cut yarn are deposited near the knitting station and accumulate as a mass of waste yarn which may be knit into the fabric, damage the needles, or be attracted to the knit fabric.

Maintaining all of the yarn ends in a single clamping device causes the positions of the yarns threaded through active and inactive yarn guides to produce an alternate zigzag pattern along the outer periphery of the knitting machine so that it is difficult to guide the yarns directly into the feeding guide slits of the yarn carriers for accurately feeding the same to the knitting needles. Also, the trailing yarn end cut by the movable cutter in conjunction with the stationary cutter during transfer of the yarn guide from the active position to the inactive position forms floats which tend to be drawn into the fabric during continuous formation of courses of the fabric.

SUMMARY OF THE INVENTION

With the foregoing in mind, it is an object of the present invention to provide an improved yarn feeding and changing apparatus which overcomes the difficulties encountered in connection with the operation of the yarn feeding and changing apparatus of said Japanese patent application.

In accordance with the present invention, individual yarn clamping and cutting means is provided for each yarn guide so that various different types and counts of yarns can be knit without danger of slipping free of the yarn clamp. The individual clamping and cutting devices for each yarn guide also keeps the yarns in a position to be accurately fed into the feeding guide slits of the yarn carriers when the corresponding yarn guide is moved to the active position.

The yarn feeding and changing apparatus of the present invention operates so that waste yarn ends are not produced when the yarn is moved into and out of knitting position and a yarn support plate is provided to prevent the floating yarn from being drawn into the fabric. Also, the upper ends of the yarn guides are individually tiltable to an outward position for facilitating threading of a yarn through the yarn guide eye without requiring repositioning of the yarn guides which do not require yarn threading.

The yarn feeding and changing apparatus of the present invention includes a plurality of yarn guides selectively movable between inactive and active positions with selecting means for controlling the operation of the yarn guides by a program. The upper end of each of the yarn guides is connected to one arm of a bell crank lever with the other arm of the bell crank lever being connected to a yarn guide operating slide associated with each yarn guide. The lower end of each of the yarn guide operating slides is radially swingable in the annular groove and selection butts are provided on the inside of each of the yarn guide operating slides. Returning butts are provided on the outside of each of the yarn guide operating slides. Control butts are provided on the lower ends of the operating slides and are engageable with a cam for selectively raising the operating slides. Return butts are selectively engageable with a returning cam for lowering selected of the operating slides. An advancing cam is provided for swinging the lower ends of the operating slides toward the inside of the knitting machine and a selecting device is provided with one or more selectors which selectively act upon the selection butts of the operating slides. The selectors are selectively controlled by electromagnetic blocks and individual yarn clamping/cutting means is provided for clamping and cutting individual yarns at each of the yarn guides.

Each yarn clamping and cutting device includes a stationary cutter provided between a movable cutter blade and a yarn clamping plate. An operating pawl is carried by the yarn guide and is operable to open the movable cutter blade and the yarn clamping plate when a corresponding yarn guide moves from the upper active position to the lower inactive position. A cutter cam is provided for closing the movable cutter blade and the yarn clamping plate and is carried by the rotating needle cylinder.

A shifting mechanism is provided for momentarily shifting the yarn guides downwardly a slight amount from a first upper active position to a second lower active yarn feeding position during introduction of the yarn to reduce the tension in the yarn as the needles begin to knit with the newly introduced yarn. The shifting mechanism includes a pivoted grooved block supporting the bell crank levers and a plunger is provided to act upon an inwardly extending leg of the grooved block to impart a slight movement to the yarn guides when a new yarn is introduced. A plunger cam is provided for engaging and raising the plunger to operate the grooved block and impart the desired movement to the yarn guides during each yarn change.

The needle cylinder is provided with a yarn trapper provided with a cam surface for guiding yarn toward the inner side with the movement of the yarn guides to the active position. A notch is provided in the trapper for catching yarn guided along the cam portion and a yarn hold down plate is provided for preventing the cut trailing end of a withdrawn yarn from being engaged by the hooks of the needles as the withdrawn yarn extends from the last needle knitting the withdrawn yarn.

Means is provided for individually tilting selected of the yarn guides to a forward position to facilitate individual threading of the yarn guides. To facilitate the outward tilting movement of the individual yarn guides to a readily accessible threading position, the yarn guides are supported at their lower ends for sliding movement in grooved guide blocks and a guide pin is provided on the inner surface of the guide block for maintaining the yarn guides in position in the grooves in the guide block during normal movement between active and inactive positions. Opposite ends of the guide pin are supported in vertical sliding members and a spring normally operates to maintain the guide pin in the upper operative position. In order to swing or tilt the upper end of one of the individual yarn guides to the forward position, the slide members are lowered to lower the guide pin from its guiding position so that the lower end of the yarn guide is released to permit the upper end of the yarn guide to be tilted outwardly so that the associated yarn guide eye is clearly accessible for threading a new yarn therein.

BRIEF DESCRIPTION OF THE DRAWINGS

Other objects and advantages will appear as the description proceeds when taken in connection with the accompanying drawings, in which --

DESCRIPTION OF THE ILLUSTRATED EMBODIMENT

Figure 1:
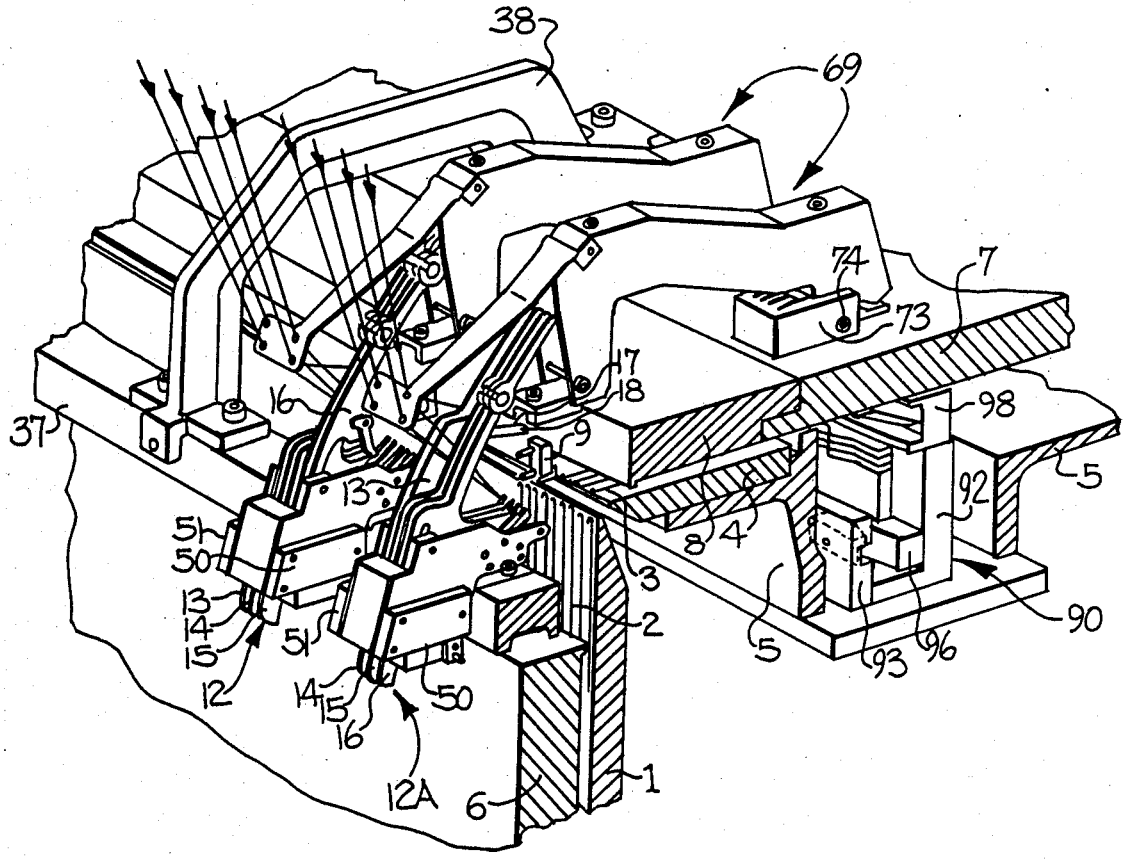
FIG. 1 is a fragmentary isometric view of the dial and needle cylinder of a circular knitting machine and illustrating two sets of yarn guides positioned thereon.
Figure 2:
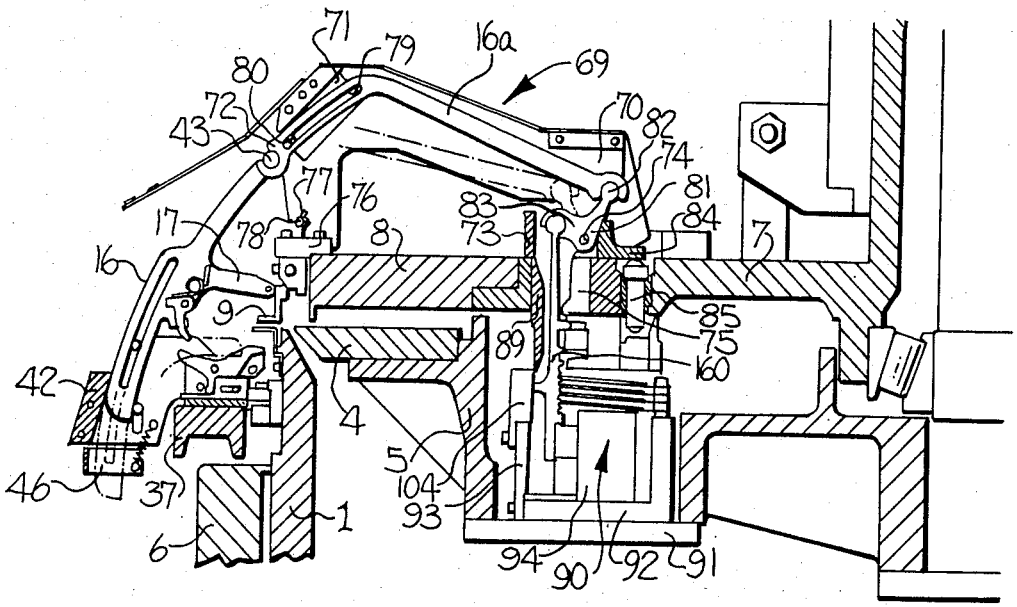
FIG. 2 is a fragmentary vertical sectional view looking at the right-hand end of FIG. 1.
Figure 3:
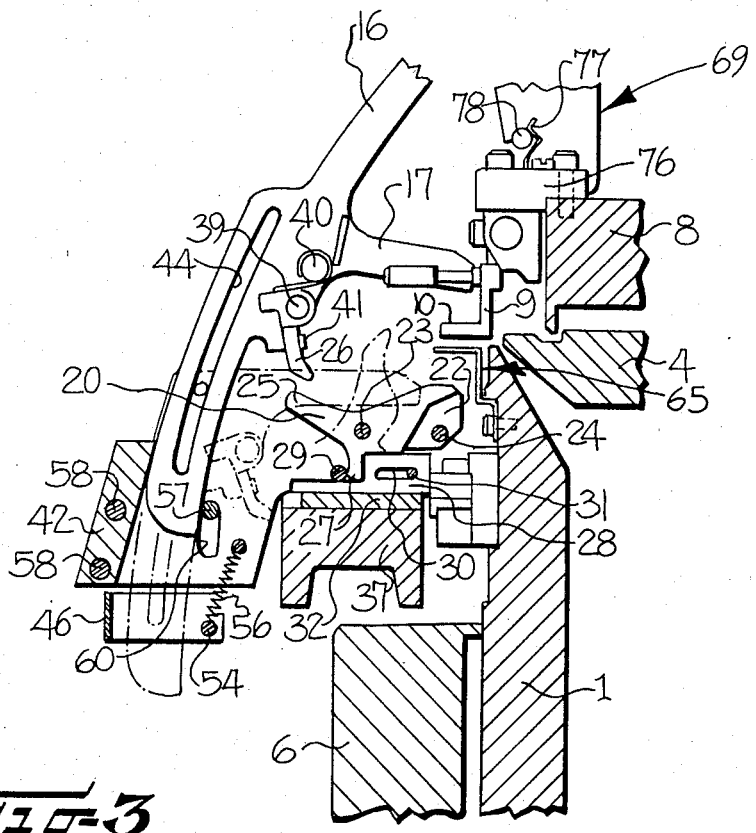
FIG. 3 is an enlarged vertical sectional view of the lower left-hand portion of FIG. 2.

As best shown in FIGS. 1-3, the circular knitting machine includes a rotating needle cylinder 1 provided with the usual vertically movable needles 2 retained in needle grooves extending around the outer surface of the needle cylinder 1. Dial needles 3 (FIG. 1) cooperate with the cylinder needles 2 and are supported for horizontal sliding movement in the usual slots in a rotating dial 4. The rotating cylinder 1 and the dial 4 are driven by the conventional driving mechanism of the knitting machine and rotate at the same rotational speed. Movement of the cylinder needles 2 and the dial needles 3 is controlled in the usual manner by conventional cams, not shown, supported in a cylinder cam holder 6 and a dial cam holder 8 supported on a fixed dial cap hub 7 (FIG. 1).

Figure 7:
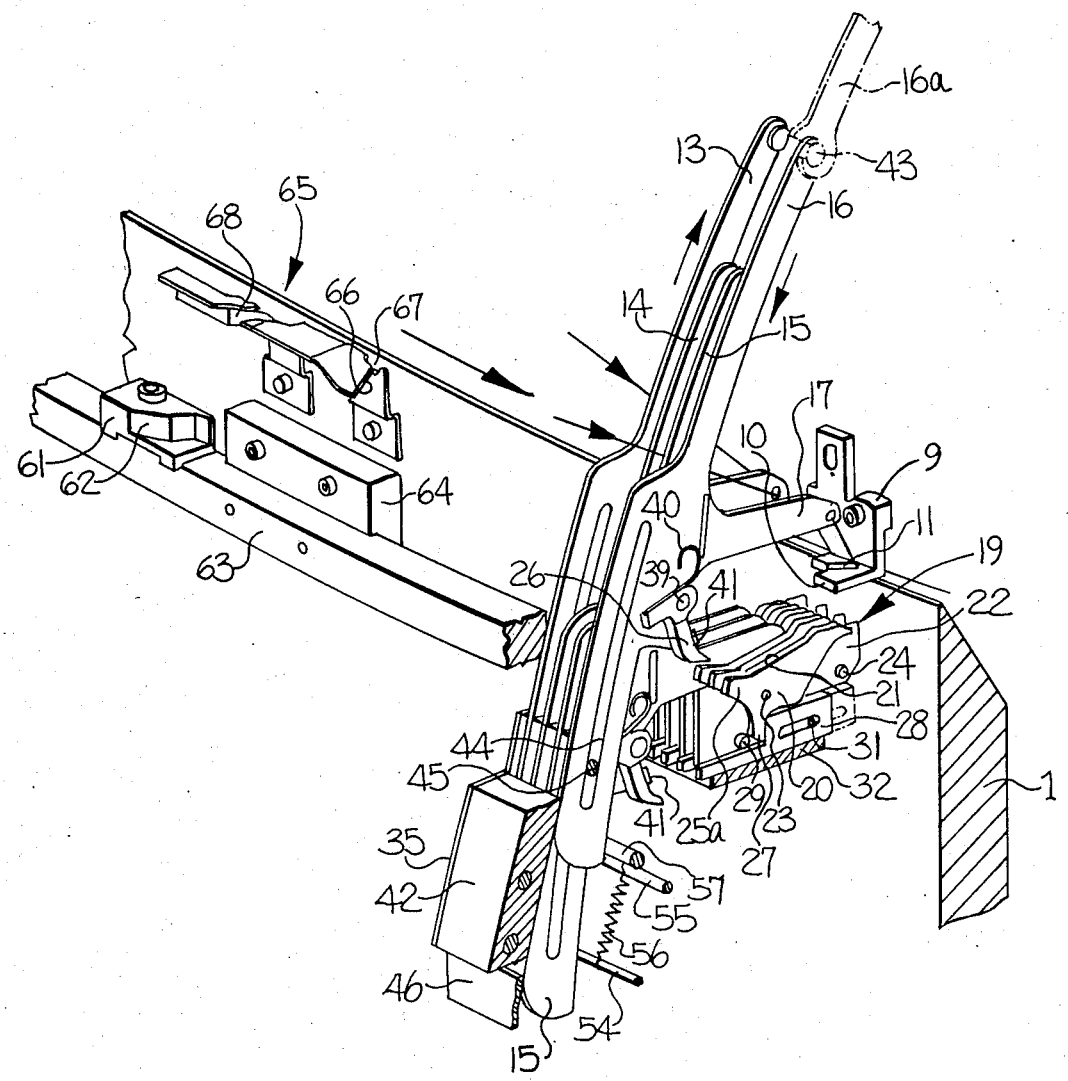
FIG. 7 is a fragmentary isometric view of one set of yarn guides with the associated individual yarn cutting and clamping means associated therewith.

Only two yarn feeding and changing devices, broadly indicated at 12 and 12A, are shown in FIG. 1. However, it is understood that the knitting machine is normally provided with a yarn feeding and changing apparatus at each knitting station positioned around the needle cylinder 1. A yarn carrier 9 is fixed to the dial cam holder 8 and adjacent each yarn feeding and changing apparatus. As shown in FIG. 7, the yarn carrier 9 is provided with a yarn guide plate 10 for guiding four yarns in different positions from the yarn guides and into a yarn feeding guide slit 11 for feeding the guided yarn to the needles.

Each of the yarn feeding and changing devices 12, 12A is provided with four vertically movable yarn guides 13-16. Each of the yarn guides includes an inwardly extending finger 17 on the medial portion of its inner side with a yarn guide eye 18 for guiding respective knitting yarns therethrough. The yarn guides 13-16 are supported to be selectively moved along inwardly inclined substantially vertical paths of travel and between a lower inactive position and an upper active position while the yarns guided thereby are fed from the yarn guide eyes to the needles through the yarn carrier 9.

As shown in FIG. 1, only the yarn guide 16 of the yarn feeding and changing device 12 and the yarn guide 13 of the yarn feeding and changing device 12A are in the upper active position with the respective guide eyes 18 thereof being positioned above the level of the dial needles 3. The other yarn guides are in the lower inactive position and the respective guide eyes of these guides are below the level of the dial needles 3.

Figure 6:
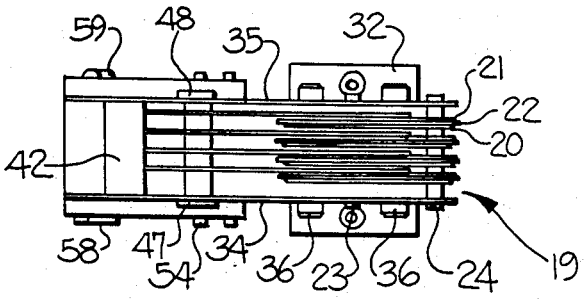
FIG. 6 is a plan view of the yarn guide assembly of FIG. 4.

One of the significant improvements of the present invention is the addition of individual clamping and cutting devices, broadly indicated at 19 in FIG. 7, for each of the yarn guides 13–16. As illustrated in FIG. 6, each of the yarn clamping and cutting devices 19 includes a stationary cutter blade 22 disposed between a movable cutter blade 20 and a movable yarn clamping plate 21. The movable cutter 20 and the movable yarn clamping plate 21, as shown in FIGS. 3 and 7, are pivotal around a pivot pin 23 while the stationary blade 22 is fixed by a pin 24. When the yarn clamping plate 21 is closed, by means to be presently described, the yarn is clamped between the yarn clamping blade 21 and one side of the stationary blade 22. The inner end portion of the movable cutter blade 20 is smaller in width than the yarn clamping plate 21 and is closed slightly later than the yarn clamping plate 21 so that the yarn is clamped before it is cut by downward engagement with the stationary cutter blade 22.

Outwardly and upwardly extending arms 25 and downwardly extending arms 27 are provided on the respective yarn cutter blade 20 and yarn clamping plate 21 to form corresponding bell cranks pivotal about the support pin 23. The arms 25 are positioned to be engaged by a ratchet pawl 26 provided on each of the yarn guides 13–16 while the other arms 27 are movable between the outer vertical edge of a slider 28 and a pin 29, both of which are located just below the stationary cutter blades 22. The slider 28 is slideable in a groove of a slider guide block 32 and the range of slideable movement is determined by a pin 31 extended through an elongated slot 30 in the slider 28.

Figure 4:
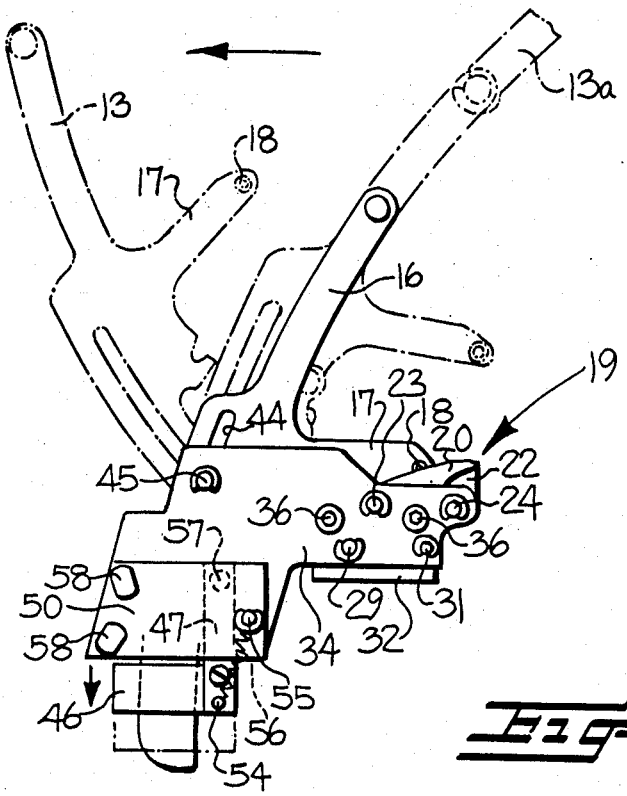
FIG. 4 is a side elevational view of one of the yarn feeding and changing devices and illustrating the upper end of one of the yarn guides being tilted or pivoted outwardly to the position to facilitate threading of the yarn guide eyelet therein.
Figure 5:
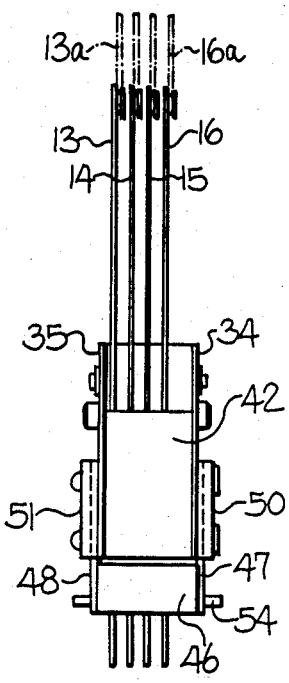
FIG. 5 is a front elevational view of the yarn feeding and changing yarn guides of FIG. 4.

As illustrated in FIG. 3, the movable cutter blade 20, the yarn clamping plate 21, the stationary cutter 22, and the slider 28 are all retained in the grooves formed in the slider guide block 32. The pivot pin 23 penetrates entirely through the movable cutter blade 20, yarn clamping plate 21, stationary cutter 22, slider guide block 32, and side plates 34, 35, as indicated in FIGS. 4–6. The pins 29 and 31 penetrate the opposite side plates 34, 35 and the slide guides 32 while the pin 24 penetrates through the stationary blades 22 and the opposite side plates 34, 35. Opposite end portions of the pins 23, 24, 29 and 31 are prevented from axial movement by snap rings or the like. The opposite side plates 34, 35 are secured to the slider guide block 32 by bolts 36 (FIG. 4). The slider guide block 32 is fixed to a striper ring 37 (FIG. 1) which is maintained in fixed position around the periphery of the needle cylinder 1 by four to six ring holders, as indicated at 38 in FIG. 1, and extending between the striper ring 37 and the dial cap hub 7.

As shown in FIGS. 3 and 7, the operating ratchet pawl 26 is pivotally supported on the respective yarn guides 13–16 by pins 39 and is normally resiliently urged in a counterclockwise direction by a spring 40 against a stop 41 projecting laterally from each of the yarn guides 13–16. When one of the yarn guides 13–16 moves from the lower inactive position, shown in dotted lines in FIG. 3, to the upper active position, shown in solid lines in FIG. 3, the operating ratchet pawl 26 contacts the arms 25 of the movable cutter 20 and the yarn clamping plate 21 and merely pivots on the pivot pin 39 and in a clockwise direction so that it does not move the movable cutter 20 and the yarn clamp plate 21. On the other hand, when one of the yarn guides 13–16 is moved downwardly from the active solid line position shown in FIG. 3 to the lower inactive position, the operating ratchet pawl 26 engages the arms 25 of the movable cutter 20 and the yarn clamping plate 21 and is prevented from rotating by the projection 41 of the yarn guide so that the arms 25 are moved downwardly to open the movable cutter 20 and the yarn clamping plate 21, as shown in dotted lines in FIG. 3.

The yarn guides 13–16 are supported for substantially vertical and inwardly inclined sliding movement in a grooved guide block 42 (FIG. 3) fixed between the outer ends of the opposite side plates 34, 35. The upper end portions of the yarn guides 13–16 are detachably connected to the outer ends of corresponding connector link members 13*a*–16*a* so that they may be easily detached therefrom, for purposes to be presently described.

A U-shaped member 46 (FIG. 4) is supported beneath the yarn guide block 42 by a pair of vertical slide members 47, 48 having their lower ends secured to the inner ends of the opposite legs of the U-shaped member 46. The slide members 47, 48 are supported for vertical sliding movement in suitable guide grooves provided on the inner sides of end plates 50, 51. A pin 54 penetrates the lower ends of the slide members 47, 48 and the lower end of a spring 56 is connected to the pin 54 and the upper end is connected to a pin 55 supported at opposite ends in the opposite side plates 34, 35. A pin 57 (FIG. 3) forms a part of the yarn guide support means and is fixed at opposite ends to the upper ends of the slide members 47, 48 and normally serves as a guide for the inner surfaces of the yarn guides 13–16. Bolts 58 penetrate through the side plates 50, 51, plates 34, 35 and the grooved guide block 42, as shown in FIGS. 4 and 6, and the opposite ends of the bolts 58 are fixed with screws 59. Vertical movement of the U-shaped member 46 is limited by the pin 57 moving in slots 60 (FIG. 3) in the opposite side plates 34, 35.

When yarn is to be threaded through a particular yarn guide, for example yarn guide 13, the yarn guide 13 is moved to the upper active position, as shown in FIG. 3, the upper end of the yarn guide is disconnected from its connecting link member 13*a*, as shown in FIG. 4, and the U-shaped, member 46 is lowered so that the pin 57 is lowered from the guiding position and below the lower end of the yarn guide 13 so that the upper end of the yarn guide 13 can easily be swung or tilted outwardly as shown in dash-dot lines in FIG. 4, thereby pivoting the yarn guide 13 around the pivot pin 45. The yarn guide eye 18 of the yarn guide 13 is thus positioned outwardly and is entirely free of obstruction to permit easy threading of a yarn therethrough. After the completion of the yarn threading, the yarn guide 13 is easily returned to the initial position by reversal of the operation steps, as heretofore described.

A cutter operating cam 61 (FIG. 7) is provided with a cam surface 62 and is fixed on a support ring 63. The support ring 63 is carried by and supported for rotation with the needle cylinder 1 by means of a support bracket 64. The cam 61 is aligned to engage the slider 28 when the same has been moved to the inwardly pushed position as shown by dash-dot lines to move the same outwardly to the solid line position.

When one of the yarn guides 13–16 is moved from the upper active position to the lower inactive position, the operating ratchet pawl 26 engages and depresses the arms 25 of the movable cutter 20 and the yarn clamping plate 21 and moves the same to the open position. The yarn is introduced to the opened movable cutter 20 and yarn clamp 21 as the yarn guide moves downwardly and the yarn is guided by the eye 18. With further rotation of the needle cylinder 1, the cutter cam 61 engages and moves the slider 28 outwardly so that the vertical outer edge of the slider 28 engages and moves the arms 27 of the yarn clamp 21 and the yarn cutter 20 outwardly so that the yarn clamp and cutter are rotated in a clockwise direction to close and first catch the yarn between the yarn clamp 21 and one side of the stationary cutter blade 22, and to then cut the yarn as the movable cutter 20 is moved down adjacent the opposite side of the stationary cutter 22.

A yarn trapper, broadly indicated at 65, is also provided on the cylinder 1 and above the cutter cam 61 (FIG. 7). The trapper 65 is provided with an inwardly slanting yarn guiding cam surface 66 and a yarn catching slot or opening 67. The cam surface 66 is used for hooking yarn which passes through the eye 18 of the yarn guide and which extends in a substantially vertical direction downwardly to the yarn clamp 21. The yarn is positioned in the vertical position as the yarn guide moves upwardly from the inactive position to the active position and the yarn is clamped by the yarn clamp 21. Thus, the introduced yarn is caught by the trapper 65 as it moves thereby and guided inwardly into the catching slot 67 by the cam surface 66 to catch the yarn so that the yarn end is prevented from floating. The yarn end caught by the catching slot 67 is guided into the feeding guide slit 11 by the yarn guide plate 10 of the yarn carrier 9 with rotation of the needle cylinder 1 and is precisely fed to the needles.

As shown in FIG. 7, when the yarn guide 16 is being moved downwardly from the active position to the inactive position, any one of the other yarn guides 13–15 is moved upwardly to the raised active position. FIG. 7 illustrates the yarn guide 16 beginning the downward movement to the inactive position, as indicated by the arrow, and the yarn guide 13 having been moved to the upper raised active position. In this condition, the yarn extending through the guide eye 18 of the yarn guide 16 is clamped and cut as just described, and a cut trailing end of the withdrawn yarn of a length of about four to six centimeters extends from the last needle knitting the withdrawn yarn. Normally, this trailing cut end of the withdrawn yarn end tends to float upwardly where it may become entangled with the hooks of the needles and be interknit in the fabric during successive loop formation. In order to prevent such entanglement, a yarn held down plate 68 is provided at the rear of the trapper part 65 to hold the cut trailing end of the withdrawn yarn in a lower position and prevent it from being again interknit in the fabric.

A yarn change occurs as the yarn trapper 65 and hold down plate 68 moves past a knitting station and a small group of needles kint both the introduced yarn and the withdrawn yarn. Thus, the yarn guide feeding the introduced yarn, such as yarn guide 13, is raised to the active position slightly ahead of the yarn guide feeding the withdrawn yarn, such as yarn guide 16, being lowered to the inactive position. The introduced yarn extends upwardly from the yarn clamp 21 and is engaged and guided into the slot 11 in the yarn carrier 9 by the cam surface 66 and slot 67 while the withdrawn yarn extends downwardly from the last needle knitting and to the yarn cutter 20, in front of the hold down plate 68, so that the floating free trailing end of the withdrawn yarn extends below the hold down plate 68 and is prevented from floating upwardly and being again interknit in the fabric.

The connecting link members **13*a*–16*a*, detachably connected at their outer ends to the respective yarn guides 13–16, are supported for lengthwise sliding movement in grooved inner and outer guide blocks 70, 71 (FIG. 2) supported in a housing 69 provided above the dial cam holder 8. As has been described, the connecting link members 13*a*–16*a* are easily detachable with the corresponding yarn guide by the pin 43. For this purpose the outer ends of the connecting link members 13*a*–16*a* are partially cut away to form semicircular parts 72. Each housing, broadly indicated at 69, is supported on its inner end by a support bracket 73 fixed to the dial cap hub 7 and is pivotal on a pin 74 extending through the support bracket 73 (FIG. 1). The support bracket 73 is provided with a vertical opening 75 (FIG. 2) which penetrates through the needle dial hub 5 and extends downwardly therefrom. A spring plate 77 is supported on a bracket 76 to which the yarn carrier 9 is fixed and locks a pin 78 so as to resiliently support the lower outer end of the housing 69** in the operative position, as shown in FIG. 1.

The lengthwise movement of the connecting links **13*a*–16*a* for transferring the yarn guides 13–16 between active and inactive positions is determined by a guide pin 80 extending through a slot 79 in the link member (FIG. 2). Opposite ends of the guide pin are fixed in the opposite sides of the housing 69. The inner ends of the link members 13*a*–16*a* are fixed to corresponding upstanding arms 82 of bell cranks 81 which are pivotally supported on the pivot pin 74. The bell cranks 81 are each provided with an outwardly extending arm 83 which serves as a connector pivotally engaging the upper ends of vertically movable yarn guide operating slides 130, 140, 150 and 160, corresponding to the yarn guides 13–16**.

Figure 8:
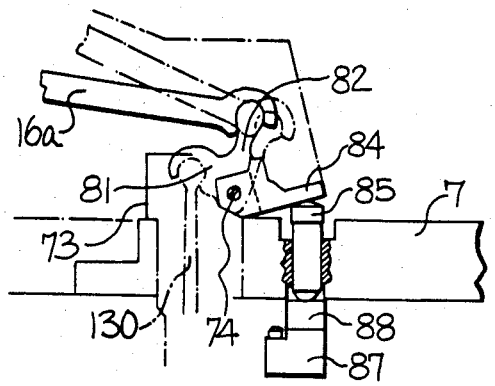
FIG. 8 is an enlarged fragmentary sectional view illustrating the bell crank and the operating plunger therefor.
Figure 12:
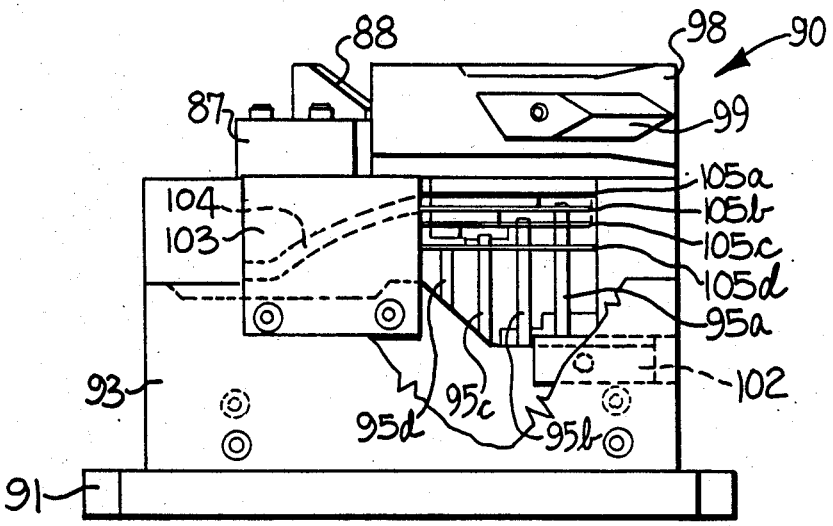
FIG. 12 is an elevational view of the selecting device of FIG. 11, looking inwardly at the lower portion thereof and with parts broken away for purposes of clarity.
Figure 13:
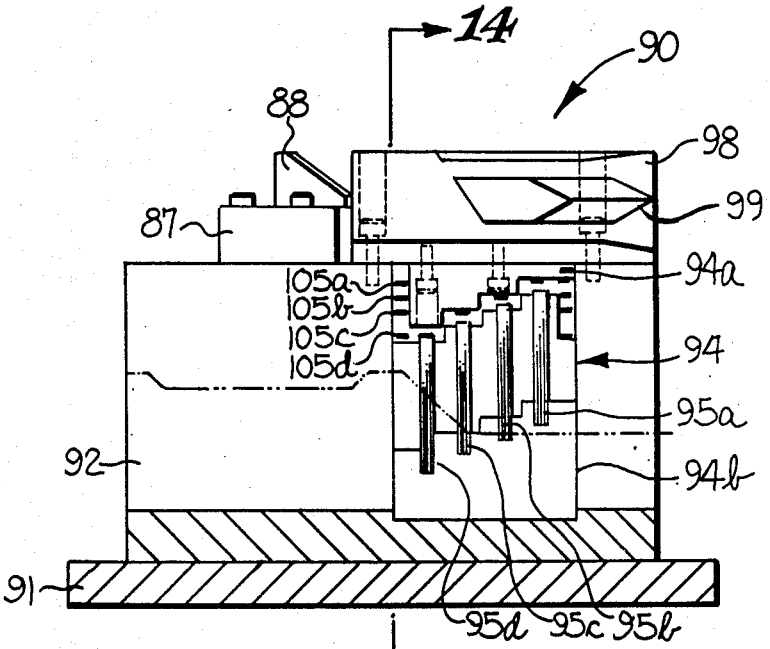
FIG. 13 is a vertical sectional view of the selecting device of FIG. 11, being taken substantially along the line 13—13.

A grooved block 84 (FIG. 8) is also pivotally supported on the pivot pin 74 and has an inwardly extending arm which engages the upper end of a vertically movable operating plunger 85. When the plunger 85 is pushed upwardly, the grooved block 84 pivots around the axis pin 74 to engage and actuate the upper arm 82. Upon movement of the lever 81 in a counterclockwise direction, the yarn guide is slightly moved downwardly, immediately after being moved from the inactive lower position to a first upper active position. The yarn guide is thus moved in a slight downward momentary manner to a second active position, so that tension on the yarn extending from the clamp 21 and the cutter 20 is slightly relieved so that the yarn is readily fed into feeding position with the needles so that the likelihood of yarn breakage is reduced when the yarn is initially fed to the needles. The plunger 85 is raised upwardly by a cam 87 having a cam surface 88 (FIG. 8). The cam 87 is supported on a selecting device, broadly indicated at 90, as illustrated in FIGS. 12 and 13.

Figure 9:
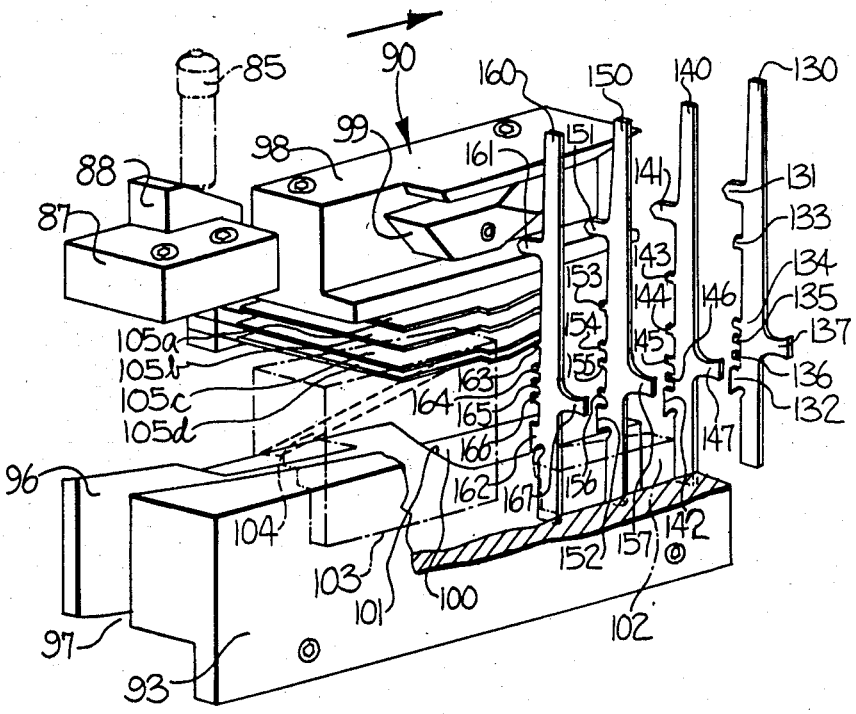
FIGS. 9 and 10 are perspective views, with parts broken away, illustrating the manner in which the lower ends of the yarn guide operating slides are controlled.
Figure 10:
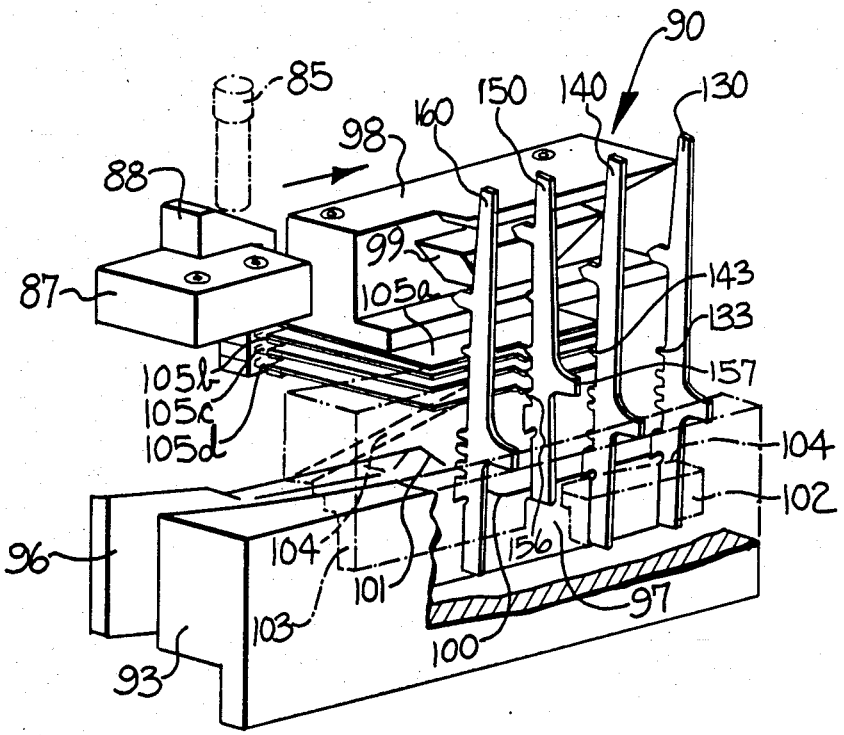

As best shown in FIGS. 9 and 10, the four vertically movable yarn guide operating slides 130, 140, 150 and 160 are provided for the respective yarn guides 13, 14, 15 and 16. The vertically movable yarn guide operating slides are vertically disposed in the dial cap hub 7 and suspended in a cylindrical body 89 of the support 73

(FIG. 2). The lower ends of the operating slides 130, 140, 150 and 160 can swing in a radial inward and outward position without changing the position of the corresponding yarn guide and are moved vertically to move the corresponding yarn guide back and forth between active and inactive positions. The lower end portions of the operating slides 130, 140, 150 and 160 are provided with inwardly facing respective guide butts 131, 141, 151 and 161; control butts 132, 142, 152 and 162; selection butts 133, 143, 153 and 163; and, further, sets of additional selection butts 134, 135 and 136; 144, 145 and 146; 154, 155 and 156; and 164, 165 and 166. A single returning butt 137, 147, 157 and 167 is provided on the outer portions of each of the corresponding operating slides 130, 140, 150 and 160. The specific action of these operating butts will be described in detail in relation with the selection device hereinafter described.

Figure 14:
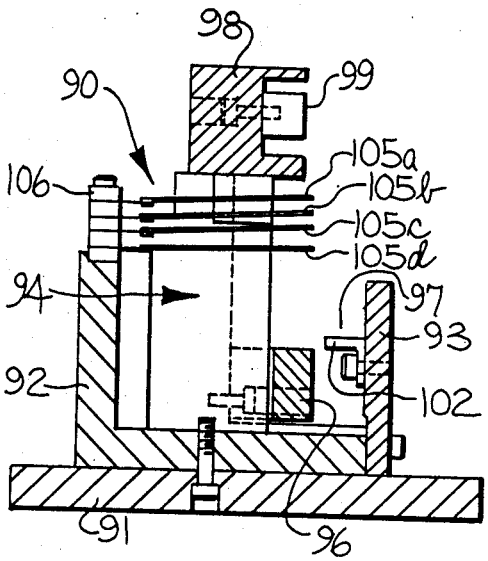
FIG. 14 is a vertical sectional view through the selection device, being taken substantially along the line 14—14 in FIG. 13.

The selection device 90 (FIGS. 2 and 14) is supported on an L-shaped bracket 92 fixed on a plate 91 which is in turn connected to the base part of the needle dial hub 5. An outer rim 93 is fixed at its lower end to the outer surface of the horizontal leg of the L-shaped support bracket 92. An electromagnetic block, broadly indicated at 94, is fixed in the space formed between the vertical leg of the L-shaped member 92 and the outer rim 93 (FIG. 14). The electromagnetic block 94, as illustrated in FIG. 13, includes an upper part 94*a* and a lower part 94*b* separated by a stepped groove. Cores 95*a*–95*d* extend between the stepped upper and lower parts 94*a*, 94*b*. As shown in FIG. 14, an inner rim 96 is fixed to the lower end of the lower part 94*b* and forms an annular U-shaped groove 97 between the outer rim 93 and the upper surface of the horizontal leg of the L-shaped member 92. The lower end portions of the operating slides 130, 140, 150 and 160 are swingable radially and movable vertically in the annular U-shaped groove 97 in a manner to be presently described.

On the upper part 94*a* of the electromagnetic block 95, a cross-sectionally angular bracket-shaped block 98 is fixedly mounted. A control cam 99 is provided on the cam block 98 for controlling the movement of the guide butts 131, 141, 151 and 161 of the respective operating guides 130, 140, 150 and 160. The top of the outer rim 93 which forms the U-shaped groove 97 is formed so as to contact with the lower edges of the returning butts 137, 147, 157 and 167, and causes the respective yarn guides to be in the lower inactive position when the corresponding operating slides 130, 140, 150 and 160 are in the lower position and the lower ends thereof are moved outwardly toward the outside of the knitting machine. On the other hand, when the operating slides 130, 140, 150 and 160 are in the higher or raised position and their lower ends are moved inwardly toward the center of the knitting machine, the top of the inner rim 96, which forms the annular groove 97, is in engagement with the lower portions of the control butts 132, 142, 152 and 162 so that the corresponding yarn guides 130, 140, 150 and 160, are in the raised active position.

The inner rim 96 is provided with a recess 100, shaped like a ship's bottom, and provided with an upwardly directed cam surface 101 which acts as a control cam for lifting the operating slides 130, 140, 150 and 160 to the higher position. In a position opposite the recess 100, an advancing cam 102 is fixed on the inner surface of the outer rim 93 (FIG. 14) and acts upon the lower ends of the operating slides so as to radially press the lower ends toward the center of the knitting machine and to position the lower control butts on the recess 100.

Figure 11:
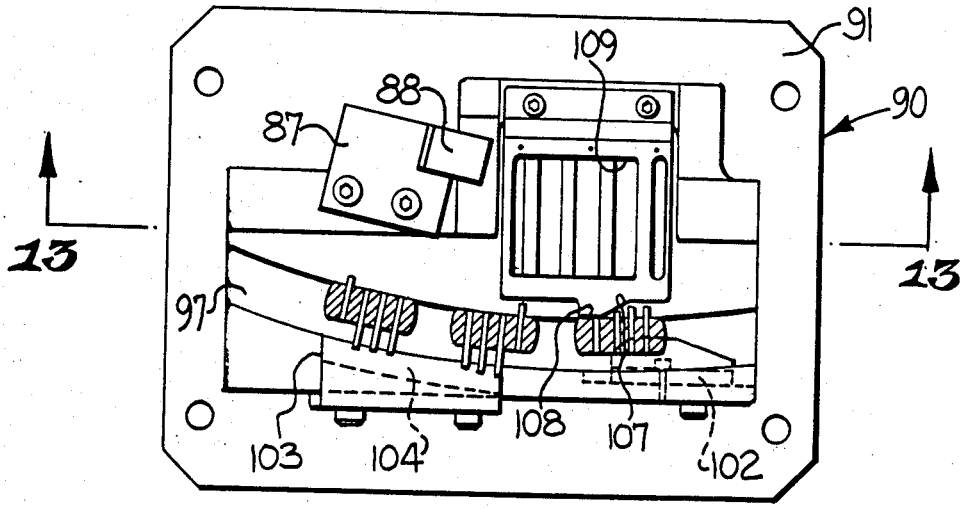
FIG. 11 is a plan view, with parts in section, of the selecting device of FIGS. 9 and 10.

A returning cam 103 is fixed to the upper end of the outer rim 93 (shown in dash-dot lines in FIGS. 9 and 10 and in solid lines in FIG. 11) and is provided with an inclined cam groove 104. The cam groove 104 engages the returning butts 137, 147, 157 and 167 of the operating slides when in the higher active position for returning the operating slides to the lower position.

Selection of the movable operating slides 130, 140, 150 and 160 is carried out by four selector plate members 105*a*–105*d* which are fixed at their inner ends by spring plates to a support 106 (FIG. 14) supported on the upper end of the vertical leg of the L-shaped member 92. The outer ends of the selector plates are maintained in parallel spaced relationship and their outer ends are free with a controlling cam projection 108 being provided on the outer portions thereof and having a cam surface 107 formed therewith (FIG. 11) to act upon the selection butts of the respective operating slides 130, 140, 150 and 160, in a manner to be described below. Vertical displacement of the controlling cam 108 is determined by the distance between the lower surface of the stepped groove formed between the upper part 94*a* and the upper ends of the corresponding cores 95*a*–95*d*. The central portion of each selector plate is cut away to provide a large rectangular opening 109 (FIG. 11) through which the stepped parts of the electromagnetic block 94 extend.

The electromagnetic block 94 selects and controls the vertical position of the selector plates 105*a*–105*d* by actuating the corresponding core members 95*a*–95*d*. The cores are actuated in a predetermined arrangement by information carried by a program device of any suitable type. For example, the program device may include optical film, punch tape, matrix, and other known information carriers or storag devices.

In contrast with the control butts 132, 142, 152 and 162, which are positioned in the same level for all types of operating slides, selection butts 133, 134, 135 and 136 are positioned at different levels, according to the type of the operating slide. When the yarn guides 13–16 are in the lower inactive position, the selector butts are positioned to correspond to respective levels of controlling projections 108 of the four selector plates 105*a*–105*d* and are usually in their upper or horizontal outwardly extending positions. In this position, ample spaces are provided vertically between the four selector butts so that the butts will not engage the controlling projections 108 of the selectors 105*a*–105*d* when the selectors are moved downwardly with the action of the corresponding cores 105*a*–105*d* of the electromagnets 105.

Method of Operation

The action of the yarn feeding and changing apparatus of the present invention will now be described with particular reference to FIGS. 9 and 10. The selecting device 90 rotates in the direction of the arrow, that is, in a counterclockwise direction. If the four yarn guides 13–16 are all in the lower inactive position, the lower ends of each of the operating slides travels along the annular extending U-shaped groove 97 and the lower ends are pressed inwardly toward the center of the knitting machine by the advancing cam 102 so that the control butts 132, 142, 152 and 162 are moved inwardly over the recess 100 of the inner rim 96. With actuation of a particular core member, such as core member 95*c* of the electromagnetic block 90 by the information program, the corresponding selector 105*c* moves to the lower vertical position. With further rotation of the needle dial hub 5, the controlling cam projection 108 of the selector 105*c* passes below the corresponding selector butt 153 and the corresponding operating slide 150 remains in the inwardly moved position so that the corresponding control butt 152 is engaged by the cam surface 101 to raise the corresponding operating slide 150 upwardly.

Upward movement of the operating slide 150 causes a corresponding movement of the yarn guide 15 from the lower inactive position to the raised active position so that the yarn is fed to the needles of the knitting machine in the manner previously described. At the same time, the other three selector butts 133, 143, and 163 are pressed outwardly by the controlling projections 108 of the selector plates 105*a*, 105*b* and 105*d* so that the operating slides 130, 140 and 160 are not raised and the corresponding yarn guides 13, 14 and 16 remain in the lower inactive position.

The use of the sets of three additional butts positioned on the inner surfaces of the operating slides and between the lower control butt and the upper selection butt will now be described. When one of the operating slides 130, 140, 150 or 160 is moved to the higher position by a corresponding control butt engaging and riding up the inclined cam surface 101, the additional butts raise to the same level as that of the controlling projections 108 of the selector plates 105*a*–105*d*. When the selector plates 105*a*–105*d* are selected by the respective electromagnetic cores 95*a*–95*d*, the selector plates are not on the same level as that of the additional selector butts.

FIG. 10 illustrates the selection action when a new selection is being made. In this case, the selector plate 105*d* is moved downwardly by the core 95*d* being actuated. The operating slide 150 that has been selected in the previous operation stays in a high position during rotation of the needle dial hub 5 whereas the other three remaining operating slides 130, 140 and 160 are again pressed in the direction toward the center of the knitting machine by the action of the advancing cam 102. During passage of the selector, only the selection butts 133 and 143 of the respective operating slides 130 and 140 are pushed outwardly by the controlling projections 108 of the selector plates 105*a* and 105*b*, but the operating slide 160 does not receive the action of the selector 105*d* and engages with the cam surface 101 so that the operating slide 160 is raised and the corresponding yarn guide 16 moves upwardly to the active position to feed another yarn to the needles.

On the other hand, the controlling projection 108 of the selector plate 105*c* pushes backwardly the additional butt 156 of the movable member or operating slide 150, that has been raised previously, and the additional butt 156 is directed toward the outside of the knitting machine. At this time, the returning butt 157 engages with the returning cam 103 and the operating slide 150 is returned to the lower position so that the corresponding yarn guide is returned to the lower inactive position.

Thus, if these additional butts are used, changing of the yarn guides 13–16 can be carried out by controlling the selector program only without using auxiliary mechanisms.

In the drawings and specification there has been set forth the best mode presently contemplated for the practice of the present invention, and although specific terms are employed, they are used in a generic and descriptive sense only and not for purposes of limitation, the scope of the invention being defined in the claims.

That which is claimed is:

1. A yarn feeding and changing apparatus for a circular knitting machine including a rotating needle cylinder, a plurality of knitting stations spaced around said needle cylinder, a plurality of yarn guides positioned at each of said knitting stations, means for selectively moving said yarn guides between lowered inactive position and raised active position, a selecting device for controlling the movement of said yarn guides by a program, an individual yarn clamping and cutting device operatively associated with each of said yarn guides, operator means carried by each of said yarn guides for engaging and moving the corresponding clamping and cutting device to an open position in response to movement of a corresponding yarn guide from an active to an inactive position, and cam means carried by said needle cylinder and being operable to move an open clamping and cutting device to a closed position.

2. A yarn feeding and changing apparatus according to claim 1 wherein each of said yarn clamping and cutting devices comprises a stationary cutter blade, a movable cutter blade positioned on one side of said stationary cutter blade, and a movable clamping plate positioned on the other side of said stationary cutter blade, and wherein said operator means comprises a pawl for engaging and moving said movable cutter blade and said movable clamping plate to the open position.

3. A yarn feeding and changing apparatus according to claim 2 including slider plate means having an outer end engaged by said movable cutter blade and said movable clamping plate and being moved inwardly toward said needle cylinder when said movable cutter blade and said movable clamping plate are moved to the open position, and wherein said cam means is positioned to engage and move said slider plate means outwardly and to thereby move said movable cutter blade and said movable clamping plate to the closed position.

4. A yarn feeding and changing apparatus according to claim 3 including shifting means associated with said yarn guides for imparting a momentary slight downward movement to said yarn guides to shift the same between an upper first active position and a lower second active position, said shifting means being operable to reduce tension on the yarn when initially fed to reduce yarn breakage.

5. A yarn feeding and changing apparatus according to claim 4 wherein said shifting means includes operator means associated with said yarn guides and being operable to impart the momentary slight downward movement to said yarn guides, and cam means rotatable with said needle cylinder and being engageable with said operator means for imparting movement thereto.

6. A yarn feeding and changing apparatus according to claim 1 including yarn trapper means carried by said needle cylinder and comprising a guide surface for guiding an introduced yarn inwardly with movement of said yarn guides to the active position, a yarn catching slot for receiving yarn guided inwardly by said guide surface, and a yarn hold down plate for preventing the cut trailing end of a withdrawn yarn from being engaged by the hooks of the needles as the withdrawn yarn extends from the last needle knitting the withdrawn yarn.

7. A yarn feeding and changing apparatus according to claim 1 wherein said yarn guide moving means includes an elongate operating link having outer and inner ends operatively connected at the outer end to a corresponding yarn guide and operatively connected at the inner end to said selecting device, and means detachably connecting said outer end of each of said elongate operating links to the corresponding yarn guide.

8. A yarn feeding and changing apparatus according to claim 7 including means normally supporting said yarn guides for sliding movement along an inwardly inclined path of movement between the active and inactive positions, and manually operable guide means associated with said yarn guide support means for permitting outward tilting movement to be imparted to said yarn guides for facilitating threading of yarn therethrough.

9. A yarn feeding and changing apparatus according to claim 8 wherein said yarn guide support means comprises a support bracket having grooves slideably supporting the lower ends and the outer sides of said yarn guides therein, and wherein said manually operable guide means includes a guide pin normally engaging the inner sides of the lower portions of said yarn guides and maintaining the same in position in said support bracket, and resilient means for maintaining said guide pin in engagement with said yarn guides, said resilient means permitting the manual movement of said guide pin out of engagement with said yarn guides to permit the outward tilting to be imparted to said yarn guides.

10. A yarn feeding and changing apparatus for a circular knitting machine including a rotating needle cylinder, a plurality of knitting stations spaced around said needle cylinder, a plurality of yarn guides positioned at each of said knitting stations, means for selectively moving said yarn guides between lowered inactive position and raised active position, a selecting device for controlling the movement of said yarn guides by a program, and shifting means associated with said yarn guides for imparting a momentary slight downward movement to said yarn guides to shift the same between an upper first active position and a lower second active position, said shifting means being operable to reduce tension on the yarn when initially fed to reduce yarn breakage.

11. A yarn feeding and changing apparatus according to claim 10 wherein said shifting means includes operator means associated with said yarn guides and being operable to impart the momentary slight downward movement to said yarn guides, and cam means rotatable with said needle cylinder and being engageable with said operator means for imparting movement thereto.

12. A yarn feeding and changing apparatus for a circular knitting machine including a rotating needle cylinder, a plurality of knitting stations spaced around said needle cylinder, a plurality of yarn guides positioned at each of said knitting stations, means for selectively moving said yarn guides between lowered inactive position and raised active position, a selecting device for controlling the movement of said yarn guides by a program, wherein said yarn guide moving means includes an elongate operating link having outer and inner ends operatively connected at the outer end to a corresponding yarn guide and operatively connected at the inner end to said selecting device, means detachably connecting said outer end of each of said elongate operating links to the upper end of the corresponding yarn guide, means normally supporting the lower end portions of said yarn guides for sliding movement along an inwardly inclined path of movement between the active and inactive positions during normal operation, and manually operable guide means forming a part of said yarn guide support means and being movable from a guiding position for permitting outward tilting movement to be imparted to the upper end portions of said yarn guides for facilitating threading of yarn therethrough.

13. A yarn feeding and changing apparatus for a circular knitting machine including a rotating needle cylinder, a plurality of knitting stations spaced around said needle cylinder, a plurality of yarn guides positioned at each of said knitting stations, means for selectively moving said yarn guides between lowered inactive position and raised active position, a selecting device for controlling the movement of said yarn guides by a program, an individual yarn clamping and cutting device operatively associated with each of said yarn guides, operator means carried by each of said yarn guides for engaging and moving the corresponding clamping and cutting device to an open position in response to movement of a corresponding yarn guide from an active to an inactive position, cam means carried by said needle cylinder and being operable to move an open clamping and cutting device to a closed position, shifting means associated with said yarn guides for imparting a momentary slight downward movement to said yarn guides to shift the same between an upper first active position and a lower second active position, said shifting means being operable to reduce tension on the yarn when initially fed to reduce yarn breakage, means normally supporting said yarn guides for sliding movement along an inwardly inclined path of movement between the active and inactive positions, and manually operable guide means associated with said yarn guide support means for permitting outward tilting movement to be imparted to said yarn guides for facilitating threading of yarn therethrough.

* * * * *